US006256463B1

(12) United States Patent
Manzer et al.

(10) Patent No.: US 6,256,463 B1
(45) Date of Patent: Jul. 3, 2001

(54) PRINTING SYSTEM AND PRINTING METHOD FOR PRODUCING A MIXED COLOR SHEET SEQUENCE

(75) Inventors: Hans Manzer, Seefeld; Bernd Krempel, Maintae; Manfred Lehmann, Puchheim; Rudolf Seeberger, Lochham; Hans Hahn, Unterhaching; Ruediger Siemens, Munich; Wolfgang Schullerus, Raubling; Andreas Berchtold, Hochstadt; Peter Rumpel, Feldkirchen; Manfred Wiedemer, Ismaning; Gerhard Loedermann, Munich, all of (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/485,630

(22) PCT Filed: Aug. 14, 1998

(86) PCT No.: PCT/EP98/05111

§ 371 Date: May 18, 2000

§ 102(e) Date: May 18, 2000

(87) PCT Pub. No.: WO99/09459

PCT Pub. Date: Feb. 25, 1999

(30) Foreign Application Priority Data

Aug. 13, 1997 (DE) ..... 197 35 152

(51) Int. Cl.[7] ..... G03G 21/14; G03G 15/00

(52) U.S. Cl. ..... 399/76; 271/301; 399/2; 399/82; 399/110; 399/381

(58) Field of Search ..... 399/2, 38, 76, 399/110, 112, 298, 299, 306, 381, 401; 271/301; 358/296, 401, 501

(56) References Cited

U.S. PATENT DOCUMENTS

| | | | | |
|---|---|---|---|---|
| 4,591,884 | * | 5/1986 | Miyamoto et al. | 399/374 X |
| 5,060,025 | | 10/1991 | Kümmel et al. | 399/401 |
| 5,258,809 | | 11/1993 | Wiedemer | 399/112 |
| 5,526,107 | | 6/1996 | Bronstein | 399/299 |
| 5,596,416 | | 1/1997 | Barry et al. | 358/296 |
| 5,781,823 | * | 7/1998 | Isobe et al. | 399/401 X |
| 6,101,364 | * | 8/2000 | Boehmer et al. | 271/301 X |

FOREIGN PATENT DOCUMENTS

| | | |
|---|---|---|
| 3407847 | 9/1984 | (DE) . |
| 3439901 | 5/1985 | (DE) . |
| 195 28 757 | 2/1996 | (DE) . |
| 0 239 845 | 10/1987 | (EP) . |
| 0 629 931 | 12/1994 | (EP) . |
| 08142416 | 6/1996 | (JP) . |

* cited by examiner

*Primary Examiner*—Sophia S. Chen
(74) *Attorney, Agent, or Firm*—Schiff Hardin & Waite

(57) ABSTRACT

A printer or copier includes a high speed monochrome or two color printer portion and a slower full color printer portion. Print job signals are divided into monochrome and color printed pages and sent to the corresponding printer portion. The printers, or a paper handling path between the printers, is controlled to assemble the printed pages into a predetermined sequence order.

38 Claims, 9 Drawing Sheets

PRINTING SYSTEM AND PRINTING METHOD FOR PRODUCING A MIXED COLOR SHEET SEQUENCE

BACKGROUND OF THE INVENTION

1. Field of the Invention

The present invention is directed to a printer or copier device system for performance-adapted production of a predetermined sheet sequence of monochromatically and/or chromatically printed single sheets, and is also directed to a printing method for producing a monochrome and chromatic sheet sequence.

2. Description of the Related Art

There is the problem in electrophotographic color printers having high print quality as known, for example, from European Patent Document EP-A1-0 629 931 that the same time is always required for producing a printed sheet both in monochrome printing mode as well as in chromatic printing mode. This means that what is referred to as the performance, i.e. the speed efficiency of the printer, is based on the full-color printing. When such a printer is utilized in mixed mode, then it is too slow for the usually occurring monochrome printing.

In electrophotographic high-performance printing with 70 pages per minute or more, the print jobs to be processed contain a majority of monochrome printouts. Only a small part of the print job is chromatic. For example, it can thus occur that a multitude of black-and-white successive sheets are printed within a print job and that one full-color image must be printed out then, for example when producing a brochure. When the usual color printing devices are utilized when producing such a brochure, these are relatively slow since, as already stated, the printing performance is based on the color printing performance. Such color printer devices are also complicated and cost-intensive and inefficiently utilized for mixed mode.

Color printer devices with which single-color or two-color printing can be carried out at high speed are disclosed, for example, by U.S. Pat. No. 5,526,107. In the known color printing means, continuous form paper is supplied to a transfer printing location of a photoconductor cylinder that respectively comprises electrophotographic units on two surfaces for producing multi-colored toner images. The continuous form paper is printed on the front side with a first color at the transfer printing location; the continuous form paper is subsequently redirected and supplied to a printing location at the same photoconductor cylinder that lies opposite the transfer printing location and the backside is printed thereat.

U.S. Pat. No. 5,596,416 discloses a printer device wherein a plurality of identical color printer means are arranged. Each of the color printer means is suited for monochromatic and color printing, whereby a parallel processing of images to be printed is possible.

What all of the known color printer devices have in common is that their performance is based on the color printing and, therefore, that the printer devices are uneconomically utilized for the mixed mode.

SUMMARY OF THE INVENTION

An object of the invention is to offer a multi-color printer or copier device system having high printing performance that is especially suited for the mixed mode and whose performance is based on the maximum printing performance in the monochromatic mode.

This and other objects are achieved by the inventive method of producing a predetermined sheet sequence of single sheets printed monochromatically and/or multi-colored in a printer or copier system, including a) printing a first sequence of recording media at a first speed on one side or both sides monochromatically or in two colors in a monochromatic or highlight printer unit with appertaining paper transport channel that can be individually driven and is fashioned as an independent structural unit;

b) printing a second sequence of recording media on one side or both sides in full color in a color printer unit with appertaining paper transport channel that is individually drivable and fashioned as an independent structural unit, being printed with a second, lower speed compared to the first speed;

c) the first and/or the second sequence of recording media being accepted by a paper path coupling module connectible to the paper transport channels of the monochromatic or highlight printer unit and of the color printer unit;

d) producing the sheet sequence of the recording media from the first and from the second sequence of recording media and supplying the sheets to a shared sheet collector and/or post-processor in a predetermined sequence; and e) separating incoming print data into monochromatic and color printjob data with a synchronous control and communicating the respective print job data to the corresponding printer units. The objects are the invention are provided as well as by the printer or copier system for producing a predetermined sheet sequence of single sheets printed monochromatically and/or in full color, the system including:

a) an individually drivable monochromatic or highlight color printer unit with an appertaining paper transport channel fashioned as an independent structural unit for single-sided or both-sided printing of a first recording medium as a monochrome or as highlight color print with a first speed;

b) an individually drivable color printer unit with an appertaining paper transport channel fashioned as an independent structural unit for single-sided or both-sided, full-color printing of a second recording medium with a second, lower speed compared to the first speed;

c) a paper path coupling module connectible to the paper transport channels of the monochromatic or highlight color printer unit and to the color printer unit that accepts the printed first and/or second recording media and supplies them to a shared sheet collecting means and/or post-processing means for the sheet sequence; and d) a synchronous control means connected to the monochromatic or highlight color printer unit and to the color printer unit, with which incoming print data can be separated into monochromatic and color print job data and the respective print job data can be communicated to the corresponding printer units. Advantageous embodiments of the invention are provided by the method above, whereby the sequence of the recording media in the sheet sequence is predetermined by a print data stream that contains monochromatic data and/or highlight data on the one hand and, on the other hand, color data, whereby the monochrome data or the highlight color data are supplied to the monochromatic or highlight printer unit and the color data are supplied to the color printer unit, and the sheet sequence is produced by an electronic controller according to the print data stream. The printer units and the paper path coupling module are driven time-organized by a synchronous control means, taking the printing speeds of the printer units and the sequence of the sheet sequence into consideration, such that the production of the sheet sequence ensues speed-optimized given largely parallel operation of the printer units. The recording media are printed in advance in the color printer unit, are then stored in a buffer store and are supplied time-exactly into the sequence of the recording media of the monochromatic or highlight color printer unit.

In the printer or copier system above, the monochromatic or highlight color printer unit may be a single sheet printer unit, and whereby the sequence of recording media from the color printer unit can be supplied into the output region of the monochromatic or highlight printer unit. The sheet sequence from the output region can be optionally supplied to a device output or to an internal stacking means of the device. The synchronous control controls the printer units and/or the paper path coupling module taking the printing speeds of the printer units and the sheet sequence into consideration, such that the production of the sheet sequence ensues speed-optimized given far-reaching utilization of a parallel operation of the printer units. In a preferred embodiment, the synchronous control is connected to the paper path coupling module and/or to a print data source. The sequence of the recording media from the color printer unit can be supplied into the input region of the monochromatic or highlight color printer unit.

At least one transfer printing station, an appertaining transfer printing transport path and a special paper path is provided in the monochromatic or highlight color printer unit via which sheets can be transported directly from the input region to an output region bypassing the transfer printing stations and/or the transfer printing transport path of the monochromatic or highlight color printer unit. The synchronous control comprises a device controller of the monochromatic or highlight color printer unit and a device controller of the color printer unit that may be coupled to one another according to the master-slave principle for controlling the sheet sequence. In one embodiment, the device controller of the monochromatic or highlight color printer unit is the master.

A controllable buffer storage is functionally allocated to the paper transport channel of the monochromatic or highlight color printer unit and/or to the color printer unit for the corresponding recording media. The buffer storage is arranged in the paper transport channel of the paper path coupling module.

The printer or copier device system above may include a synchronous control having the following features:

both printer units comprise a data controller, whereby the printer units are in communication with one another in the sense of a master-slave coupling;

a job separator is provided that, on the one hand, separates the incoming print data of an external data source into monochromatic and chromatic print job data, whereby, for sequence administration, each printed page comprises a specific address or feature and the respective print job data are then communicated to the corresponding printer units, and that, on the other hand, forms sequence data allocated to the sequence of the single sheets and communicates these to the printer unit having the master function, whereby the printer unit having the master function controls the other printer unit and/or the paper path coupling module for producing the sheet sequence.

Alternately, the printer or copier device system has a synchronous control means having the following features:

one of the two printer units comprises a data controller shared by both printer units;

the data controller has a job separator allocated to it that, on the one hand, separates the incoming print data of an external data source into monochromatic and chromatic print job data wherein, for sequence administration, each printed page comprises a specific address or feature, and that, on the other hand, forms sequence data allocated to the sequence of the single sheets, whereby the printer unit with the data controller controls the other printer unit and/or the paper path coupling module for producing the sheet sequence.

One of the two printer units may be fashioned as an insert means for acceptance and output of pre-printed single sheets. The paper path coupling module supplies the printed recording media to the paper transport channel of the respectively other printer unit such that it can be additionally printed by the accepting printer unit. The printer units are preferably fashioned as independently operable electrographic printer devices.

As a result of the provided coupling of a digital monochromatic printer working at high printing speed, for example a black-and-white printer or a maximum of a printer printing in two colors (highlight color printer), with a digital full-color printer, mixed printjobs wherein the sheet sequences contain individual color pages can be produced at high speed and especially economically.

A higher-ranking control unit designationally sends the pages to be printed to the respective printing unit and assures that the correct, alternate page sequence is produced in a common paper output stream.

It was inventively recognized that the electronic and mechanical coupling of the monochromatic or highlight color printing units on the one hand and of the full-color printing unit on the other hand makes it possible to produce mixed printing jobs that comprise monochrome or highlight color data on the one hand and, on the other hand, comprise full-color data, producing these print jobs with high performance and with a high degree of utilization of the two printing units.

The control unit controls the printer units in the production of the mixed printing job dependent on the incoming data stream such that both printing units—insofar as the sequence of the individual sheets in the print job allows it—work in parallel mode. The desired control and drive objective of the control is the parallel mode.

To this end, the monochrome (black-and-white) and the chromatic information from an original data stream are allocated to the respective printing unit and organized in terms of time. The shared paper path then conducts the printed single sheets—correctly sorted—into a shared deposit (for example, externally, in the output compartment of the fast monochromatic printer, in the output compartment of the color printer) or into a post-processing system in the form of a sheet/steam/or packet stream. One of the digital printer or digital copier machines having printing function can thereby also assume the collecting function on the basis of its internal paper path and/or can generate additional printed information on the delivered sheet (for example, color on the front side, black-and-white on the backside or some other arbitrary combination). The interfaces are fashioned such that the printers or copiers can be utilized according to the respective performance demands of the operator. In order to smooth different performance peaks (for example, a high sequence of monochromatic or chromatic pages), the shared paper path can contain a buffer function. The buffer function can be realized, for example, by a collecting compartment from which the printed sheets are in turn output as needed individually or in packet form. The paper path itself can be utilized as a buffer on the basis of its distance. Buffers in the form of paper loops are known for printers that process continuous form paper. The productivity of the system is enhanced by the buffer function.

Both single sheet printers (cut sheet printers) as well as printers that work with continuous form paper (fan-fold printer) can be utilized as printing units. The use of cutting devices is required given fan-fold printers.

The sheet stream produced by the color printer in a preferred exemplary embodiment is introduced into the output region of the monochromatic or highlight color printer via a suitable interface, for example via a paper path coupling module. Therein, the chromatically printed sheets are inserted in proper sequence into the sheet stream printed by the monochromatic or highlight color printer. The monochromatic or highlight color printer in this embodiment serves as a mixing means (or merging means). It is advantageous given this embodiment that the high-speed printing mode in the monochromatic or highlight color printing unit is not deteriorated by the delivery of the sheets printed in full color.

In another, advantageous exemplary embodiment, the sheets printed in full color are kept on hand in an intermediate storage. The intermediate storing makes it possible to print the full color pages in advance and to then designationally feed them into the sheet stream of the monochromatic or highlight color printing unit. Despite a slower printing speed of the full color printing unit compared to the monochromatic or highlight color printing unit, the printing speed of the overall system remains high given mixed printing jobs. The intermediate storage can ensue in the full-color printing unit or in the monochromatic or highlight color printing unit but preferably ensues in a paper path coupling module connected between the printer units. It can ensue via a stacked intermediate deposit of the sheets or via a corresponding buffer transport path that accepts a specific number of single sheets.

In another preferred exemplary embodiment, the sheet stream produced by the color printer is introduced into the input region of the monochromatic or highlight color printer via a suitable interface, for example, via a paper path coupling module having an intermediate storage. Within the monochromatic or highlight color printer, the sheets printed in full color are then optionally conducted past the transfer printing station and/or the fixing station, potentially a plurality of such stations, or are again printed therein monochromatically or in two colors at high speed. The sheets printed fullcolor are thereby inserted into the sheet stream printed by the monochromatic or highlight color printer.

The invention is especially advantageous in conjunction with a highlight color printer; applications, namely, having a high proportion of two-color prints are becoming more and more frequent in the field of electrographic high-performance printing. The page costs as well as the printing performance are then especially beneficial in an inventive printing system, namely high performance at low cost.

BRIEF DESCRIPTION OF THE DRAWINGS

Further embodiments of the invention are shown in the drawings and are described in greater detail below by way of example.

DETAILED DESCRIPTION OF THE PREFERRED EMBODIMENTS

Figure 1:
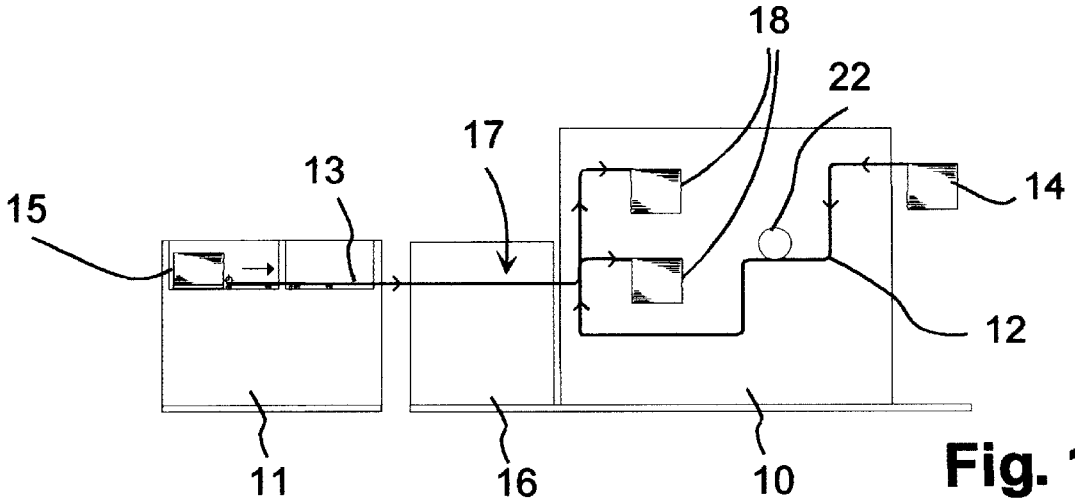
FIG. 1 is a schematic sectional view of an electrographic printer device system composed of a monochromatic single sheet high-performance printer and a single sheet color printer that are coupled to one another via a paper path coupling module, whereby the sheet collecting means is arranged integrated in the monochromatic single sheet high-performance printer.

Within the meaning of the present specification, the term "monochromatic printer unit" can usually be understood as a printer unit that can print only a single color. By comparison thereto, a printer unit that can print two colors is referred to as a highlight printer unit. Within the meaning of the invention, however, a monochromatic printer unit can often be provided in the following exemplary embodiments instead of a highlight printer unit and vice versa. What is understood, in contrast, by a color printer unit is a full-color printer unit with which all primary colors can be produced. Such color printer units can be constructed as YMCK printer units and, for example, can comprise an electrographic transfer printing station that prints yellow (Y), a magenta color (M), a cyan color (C) and black (K). Corresponding full-color ink printer units or, potentially, an offset printer device can also be provided for this purpose.

The printer or copier device systems shown in FIGS. 1 through 9 for performance-adapted production of a prescribed sheet sequence of monochromatic and/or chromatically printed single sheets fundamentally contain a digital, monochromatic printer unit 10 working at high printing speed of approximately 50, 100, 200, 400 pages per minute or more and a slow, digital color printer unit 11 having a standard printing speed of approximately 30, 50, or 100 pages per minute. Both printer units are fashioned as independent, individually drivable structural units, namely either as modules or as independent printers. They respective comprise a paper transport channel 12 or, respectively, 13 with paper transport elements, whereby the units such as exposure means, developer station, fixing station, etc., required for printing the recording media 14 or, respectively, 15 are arranged along these paper transport channels 12 or, respectively, 13. The digitally operating electrographic printers 10 and 11 are constructed in a standard way. They can be fashioned as single sheet printers or as continuous form printers with appertaining cutter device or can be fashioned as digital copier devices having a print data input. A controllable paper path coupling module 16 is arranged between the printers 10 and 11. It likewise contains one or more paper transport channels 17 with appertaining paper transport elements (rollers, etc.) that can be mechanically or, respectively, functionally coupled to the paper transport channels 12 and 13 of the printer units 10 and 11. The paper path coupling module 16 can be fashioned as an independent structural unit in the form of a module or can be fashioned as a part integrated in one of the printer units 10 and 11. Basically, the paper path coupling module 16 connects the paper transport channels 12 and 13 of the printer units 10 and 11. Depending on the embodiment, it takes the printed single sheets from the paper channel of the one printer unit (for example, the color printer 11) and conducts them to the paper channel of the other printer unit (for example, the monochromatic printer 10), where they are deposited as a monochromatically and chromatically mixed job in a common sheet collecting means 18 (stacker) (FIGS. 1, 2, 3, 5) or, on the other hand, it takes the printed single sheets from both printer units 10, 11 (FIGS. 4, 6–9) and conducts them with the predetermined sheet sequence to a shared output path 19 (FIGS. 4, 6 through 9). A post-processing means, for example, a binder means or a sheet collecting means 18 in the form of a stacker, can be coupled to the output path 19.

A higher-ranking control unit shown in FIGS. 10 and 11 and to be explained in greater detail later allocates the single sheet to be printed to the printer units 10, 11, these then being collected as job in the shared sheet collecting means 18 or the post-processing means. In order to enable a speed-optimized production of the print job, the monochromatic and the chromatic information are separated from an original data stream of an external data source, are allocated to the respective printer unit and are organized in terms of time. In this way, a performance-adapted, time-saving and economical operation of the system can be achieved. What is thereby desired is a largely parallel operation of the printer units 10, 11.

Regarding the embodiments of FIGS. 1 through 9 in detail:

Given the exemplary embodiment shown in FIG. 1, the electrographic printer device system is composed of the monochromatic single sheet high-performance printer 10 and the single sheet color printer 11, these being coupled to one another via the paper path coupling module 16. The paper path coupling module 16 takes the chromatically printed single sheets 15 from the color printer unit 11 and conducts them so that they are organized in time to the paper channel 12 of the monochromatic printer unit 10. The sheet collecting means 18 is arranged integrated in the monochromatic single sheet high-performance printer and is composed of two deposit compartments present thereat that can be respectively individually used for constructing the mixed job. One deposit compartment can thereby be utilized as a temporary storage while the other is being filled.

Figure 2:
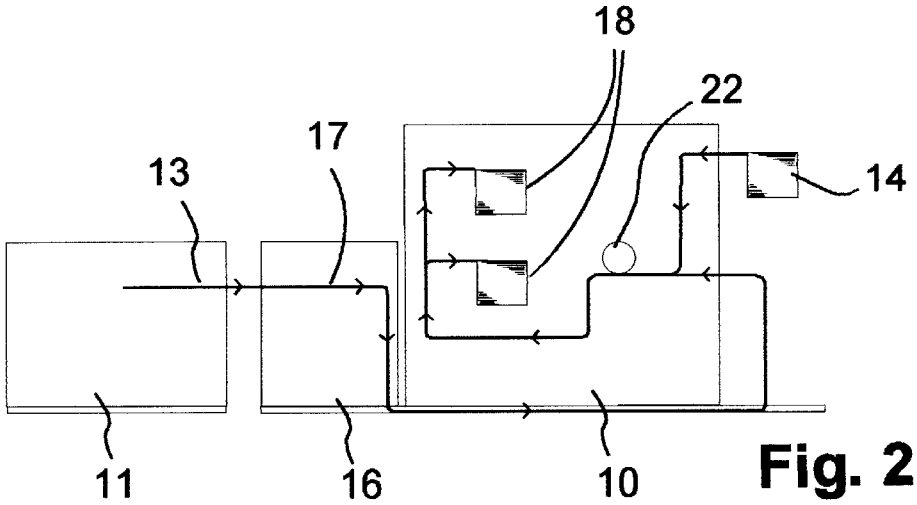
FIG. 2 is a schematic sectional view of a printer device system corresponding to FIG. 1, whereby the paper path coupling module supplies the single sheet printed chromatically to the single sheet color printer such that it can be printed anew.

In the exemplary embodiment of FIG. 2, the paper path coupling module 16 conducts the chromatically printing single sheet to the paper transport channel 12 of the monochromatic printer unit 10 preceding the actual electrophotographic unit, so that it can be additionally printed as needed. The sheet collecting means 18 is fashioned in conformity with FIG. 1. In this exemplary embodiment, it is advantageous when the monochromatic printing unit 10 comprises a contact-free fixing process such as, for example, a photoflash fixing, irradiation fixing or a fixing with solvent (what is referred to as cold fixing) because the pre-printed colored side is then not injuriously influenced by the fixing process of the monochromatic printer unit.

Figure 3:
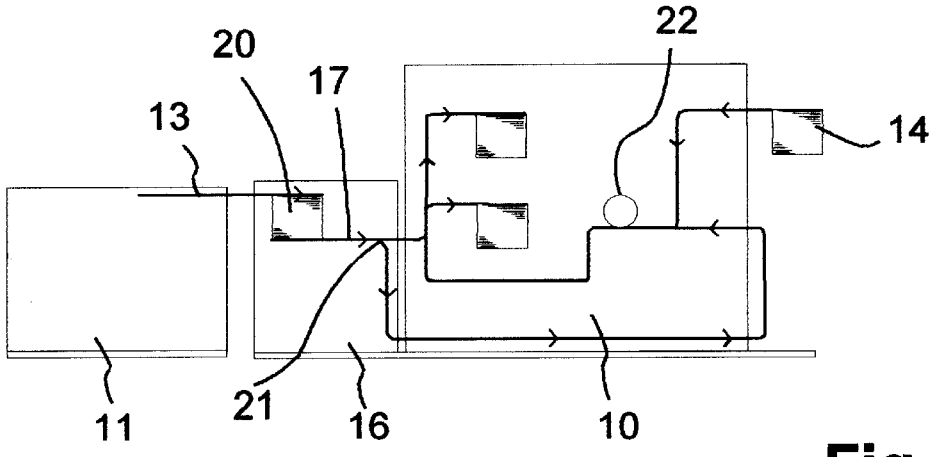
FIG. 3 is a schematic sectional view of a printer device system corresponding to FIG. 1 comprising a paper path coupling module containing a sheet buffer store and a paper shunt.

In the printer device system according to FIG. 3, the paper path coupling module 16 contains a sheet buffer storage 20 and a switchable paper shunt 21 in the paper transport channel 17. The sheet buffer storage 20 is constructed so as to be driven is and is composed of a controllable single sheet reservoir with appertaining transport elements for intermediate storage of the printed, chromatic single sheets. As a result of the buffer function, different performance peaks of the printer units 10 and 11 can be smoothed out. During the monochromatic printing of the single sheets in the fast, monochromatic printer unit 10, the chromatic single sheets are already produced with the slow color printer unit 11 and are stored intermediately in the sheet buffer store 20 until they are delivered in proper sequence to the paper transport channel 12 of the monochromatic printer unit 10. The buffer function, for example, can also be realized by a collecting compartment from which the printed sheets are in turn output as needed individually or in packet form. Depending on the switch position, the electromagnetically switchable paper shunt 21 enables the delivery of the chromatic single sheets via the paper transport channel 12 either directly to the sheet collecting means 18 or into a region preceding the electrographic printer unit 22 for renewed printing.

Figure 4:
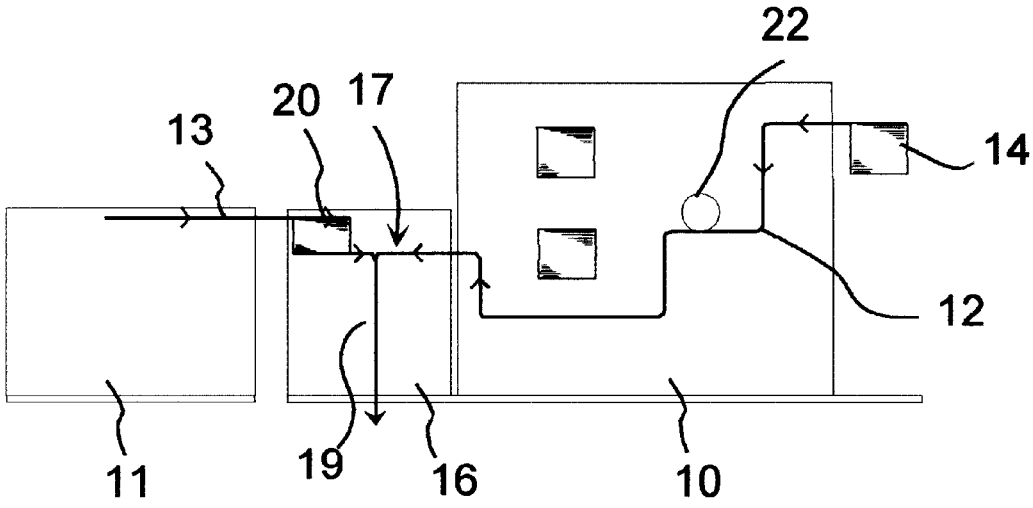
FIG. 4 is a schematic sectional view of a printer device system corresponding to FIG. 1, comprising a paper path coupling module containing a sheet buffer storage and a shared output path for the sheet sequence.

In the exemplary embodiment of the printer device system according to FIG. 4, the paper path coupling module 16 contains a sheet buffer storage 20 in a shared output path 19. The chromatic and monochromatic single sheets are merged in the paper path coupling module 16 and are output in proper sequence via the output path 19. A post-processing means, for example in the form of a binder means, can be coupled to the output path 19.

Figure 5:
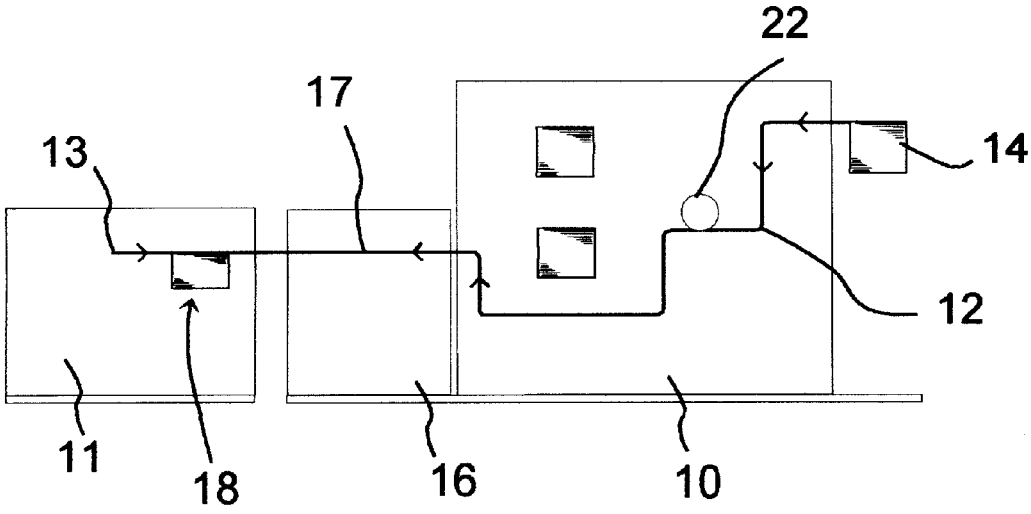
FIG. 5 is a schematic sectional view of a printer device system corresponding to FIG. 1, whereby the sheet collecting mean is arranged integrated in the chromatic single sheet high-performance printer.

The printer device system of FIG. 5 fundamentally corresponds to that of FIG. 1. Differing therefrom, the sheet collecting means 18 is arranged integrated in the chromatic single sheet printer 11.

Figure 6:
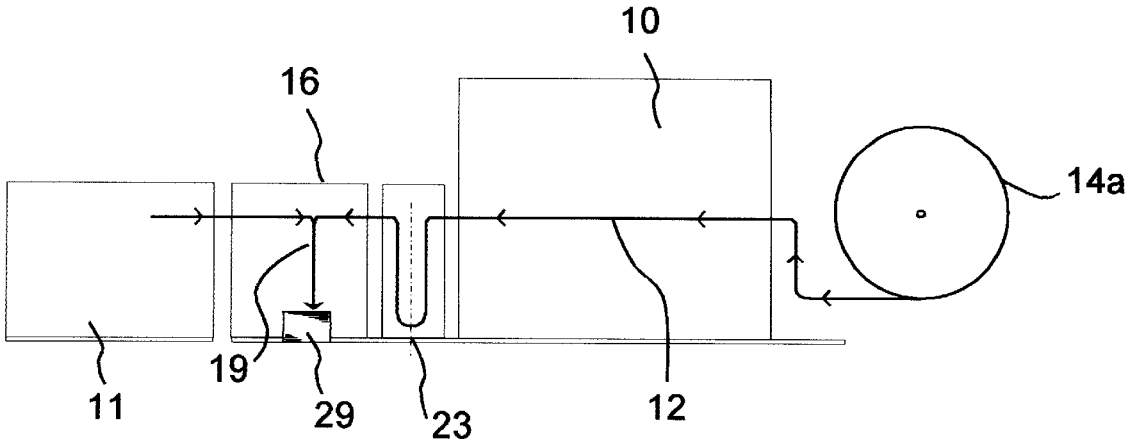
FIG. 6 is a schematic sectional view of an electrographic printer device system composed of a monochromatic continuous form high-performance printer with appertaining cutting device and a single sheet color printer that are coupled to one another via a paper path coupling module, the latter comprising a shared output path to the sheet collecting means.
Figure 7:
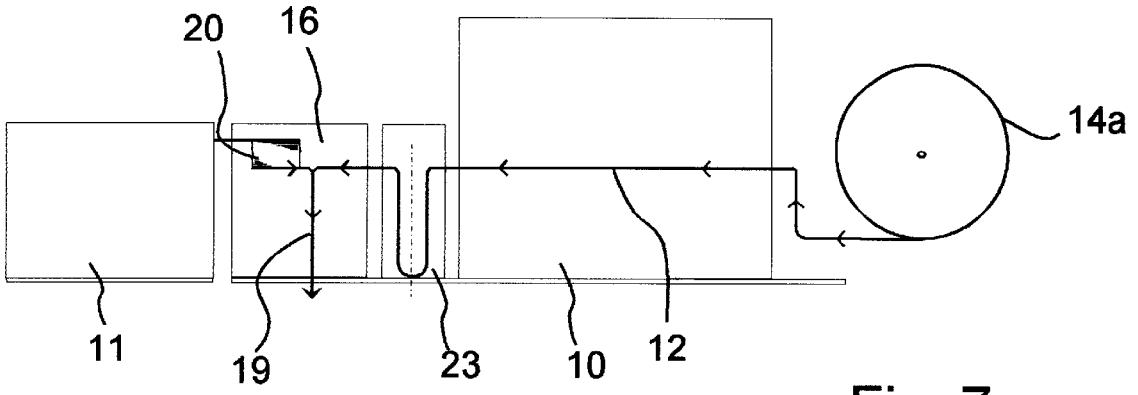
FIG. 7 is a schematic sectional view of a printer device system corresponding to FIG. 6, whereby the paper path coupling module comprises a sheet buffer store for the chromatic single sheets.

As the monochromatic printer units 10, the electrographic printer device systems of FIGS. 6 and 7 contain a monochromatic continuous form high-performance printer with an appertaining cutter means 23 for a sheet-by-sheet separation of the web-shaped recording medium 14*a*. The paper path coupling modules 16 comprise a shared output path 19. In FIG. 6, this is connected to an external sheet collecting means 29 in the form of a stacker. In the exemplary embodiment of FIG. 7, the paper path coupling module 16 additionally contains a sheet buffer store 20. Otherwise, the function of the printer device systems corresponds to the exemplary embodiment of FIG. 4. Sheets can be intermediately stored in the paper path coupling module 16, these having been previously pre-printed at relatively slow speed by the color printer unit 11. These sheets then can be supplied into the sheet stream of the monochromatic printer 10 with time and position precision. In the post-processing stacker 29, the chromatic sheets and the monochromatically printed sheets are then deposited in the sequence order of the print job.

Figure 8:
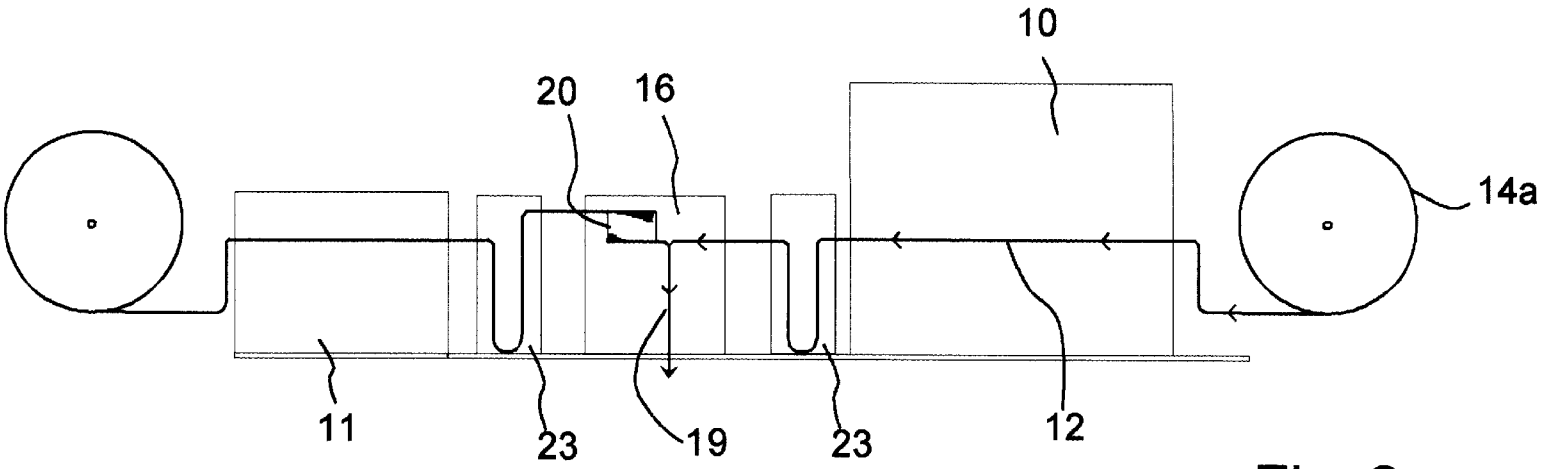
FIG. 8 is a schematic sectional view of an electrographic printer device system composed of a monochromatic continuous form high-performance printer and a continuous form color printer with appertaining cutting devices that are coupled to one another via a paper path coupling module that comprises a shared output path and a sheet buffer store for the chromatic single sheets.
Figure 9:
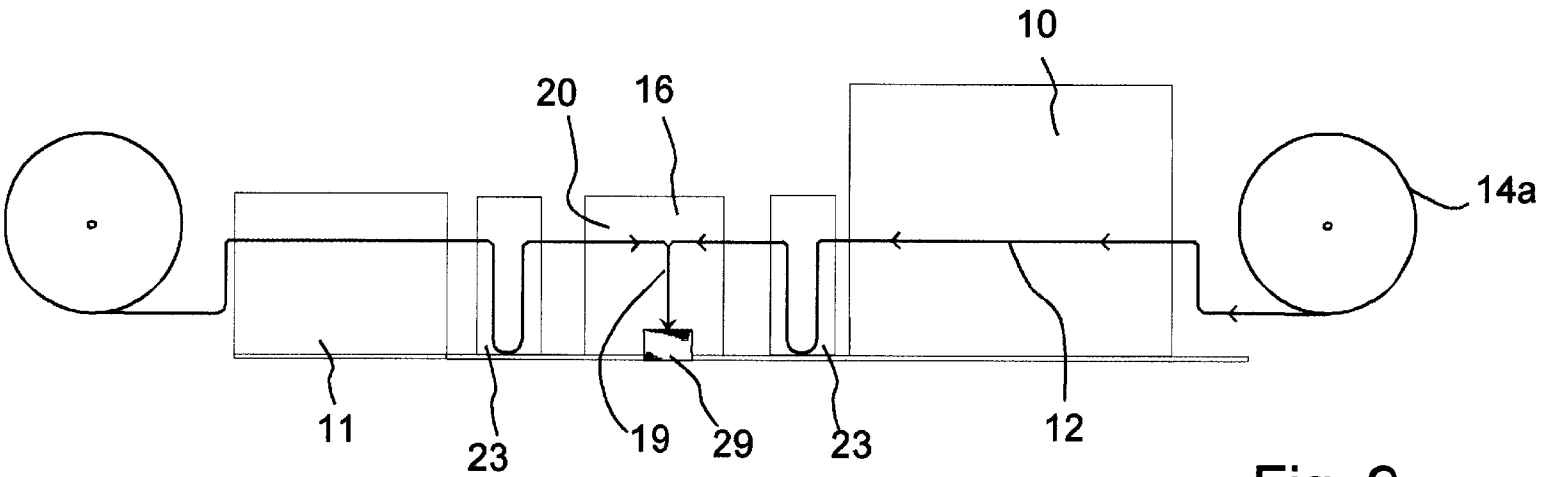
FIG. 9 is a schematic sectional view of an embodiment of a printer device system corresponding to FIG. 8, whereby the paper path coupling module comprises a shared output path to a sheet collecting means.

As shown in the exemplary embodiments of FIGS. 8 and 9, the monochromatic printer unit 10 and the chromatic printer unit 11 can be fashioned as continuous form printer units with appertaining cutter means 23. In the example of FIG. 8, the paper path coupling module 16 contains a sheet buffer storage 20 for the color pages and a shared output path 19; in the example of FIG. 9, it is a shared output path 19 that is coupled to a sheet collecting means 29. The functions correspond to those of FIGS. 6 and 7. Of course, a sheet collecting means 29 can be provided or a buffer storage 20 according to FIGS. 7 and 9 in one of the exemplary embodiments according to FIGS. 6 and 8 as well.

In order to be able to directly supply additional, preprinted single sheets to the print job to be produced, it is also possible analogous to the exemplary embodiments of FIGS. 1 through 7, for example, to replace the color printer unit 11 by an insert means in which the masters are stacked and from which the masters are supplied to the shared sheet collecting means 18 in the described way via the paper path coupling module 16. The insert means can also be provided as an auxiliary means in addition to the color printer unit 11 and can be in communication with the paper path coupling module 16 via a separate papertransport channel. Respective sheets of the differently printed type are then stored in the insert means, taken individually and inserted in exact position into the sheet stream of the connected printer.

Figure 11:
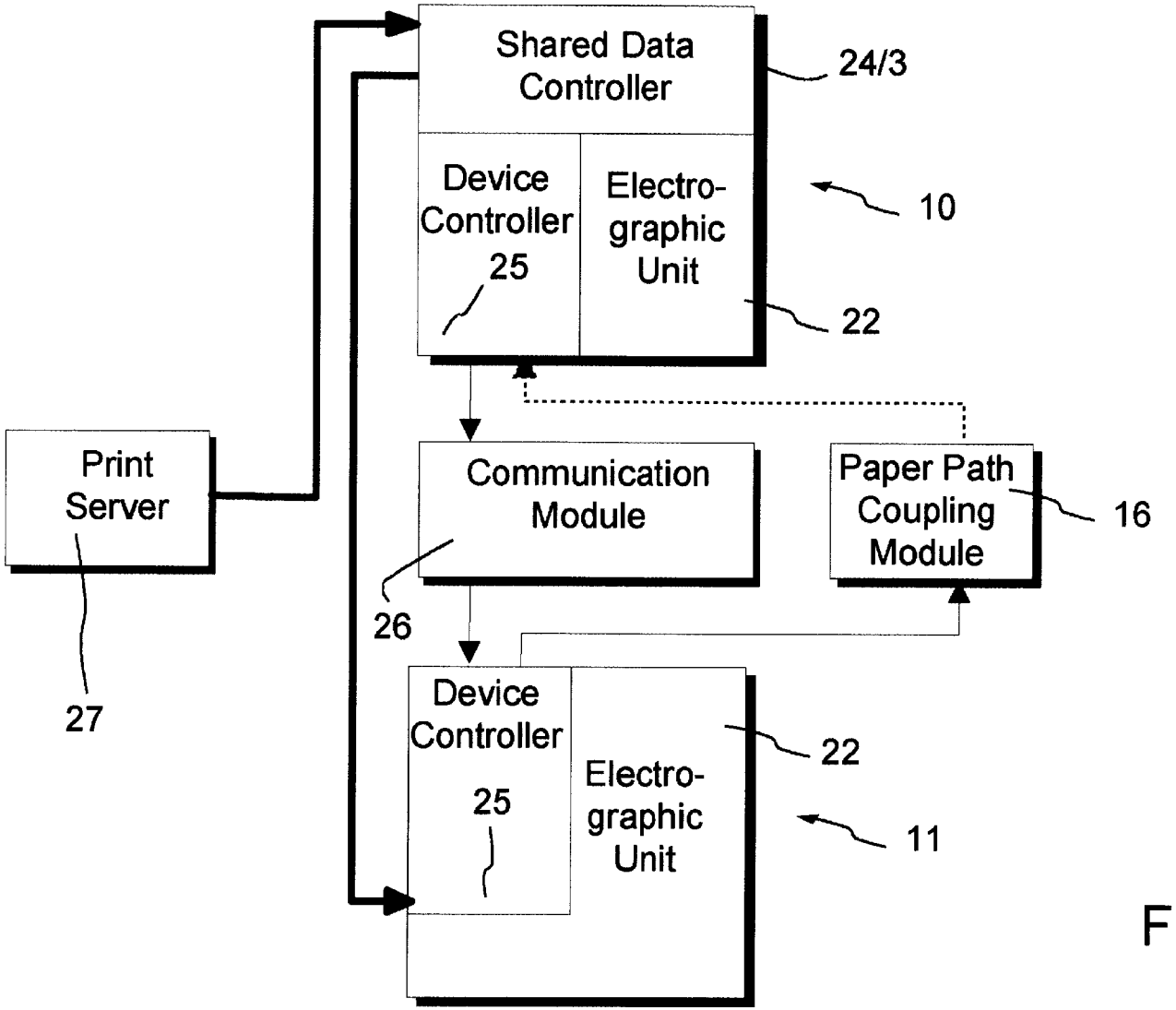
FIG. 11 is a schematic block circuit diagram of a controller for the electrographic printer device system composed of two printer devices having a shared data controller.

It can be alternatively provided in the exemplary embodiments of FIGS. 6 and 11 to fashion the color printer 11 as a continuous form printer and to fashion the monochromatic printer 10 as a single sheet printer.

SYSTEM CONTROLLER

Figure 10:
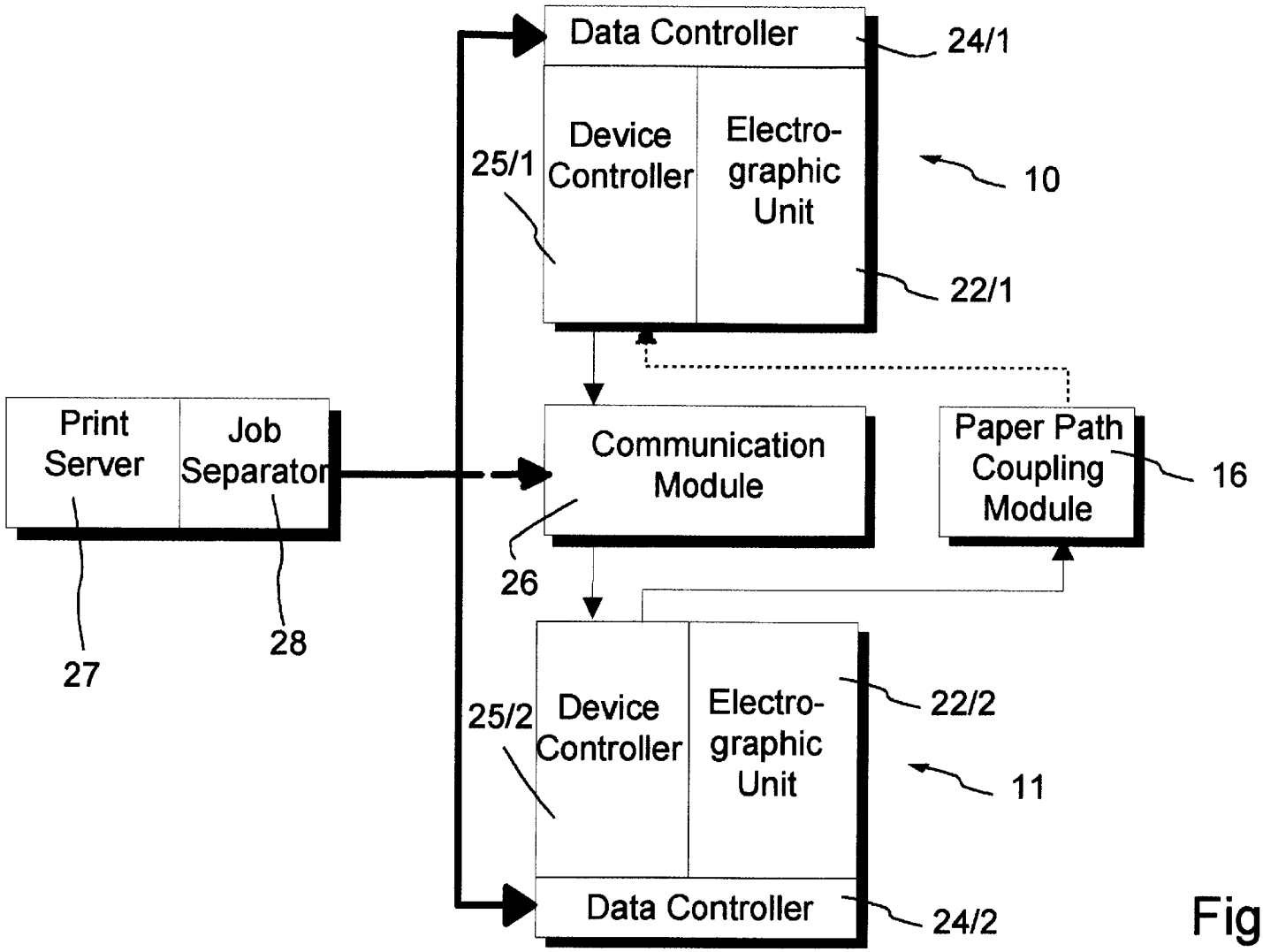
FIG. 10 is a schematic block circuit diagram of a control for the electrographic printer device system composed of two printer devices respectively comprising a controller.

Synchronous controller devices as shown as block circuit diagrams in FIGS. 10 and 11 serve for the control of the printer system.

In the exemplary embodiment of FIG. 10, both the monochromatic printer unit 10 as well as the chromatic printer unit 11 has a separate data controller 24/1 and 24/2. The control of the electrographic units 22/1 and 22/2 respectively ensues via a standard device controller 25/1 or, respectively, 25/2. The fundamental structure of data controller and device controller is known, for example, from European Patent Document EP-B1-0239845 (86P1149). Since both printer units 10 and 11 respectively comprise a data controller respectively, or comprise a device controller, they can also be operated as separate devices independently of one another.

In the system, the two printer units 10 and 11 are coupled to one another according to the master-slave principle via a communication module 26 on an apparatus control level. The faster, monochromatic printer unit 10 with its data controller 24/1 thereby preferably assumes the master function. This principle has likewise been described in general in European Patent Document EP-B1-0239845.

A print server 27 that comprises an integrated job separator 28 is functionally connected to the two data controllers 24/1 and 24/2 and to the communication module 26 via data lines (data buses). The print server 27 in turn communicates with an external data source, for example a PC, a data network or a host. The paper path coupling module 16 is likewise coupled to the printer units 10 and 11 via control lines.

The function of the synchronous control means is thereby as follows: the print data coming from the external source are separated into monochromatic and chromatic print job data in the job separator 28 of the print server 27 and are thereby assigned a specific address or a characterizing feature for sequence administration of each printed page. These data are then transmitted to the data controllers 24/1 and 24/2 of the respective printer units 10,11. At the same time, the master printer unit, the monochromatic printer unit 10 in this case, is informed of the sequence of the printed pages as sequence data from the print server 27. The master printer 10 then controls the color printer 11 with the paper path coupling module 16 such via the communication module 26 that this delivers the printed color pages to the monochromatic printed pages at the proper point in time via the paper path coupling module 16, namely in the way set forth in conjunction with FIGS. 1 through 9. It can thereby be necessary that the color pages are intermediately stored in the paper path coupling module 16 in the sheet buffer store 20 or in the paper transport channel. This correct point in time is calculated—taking the different printing speeds of the printer units 10 and 11 and the sheet sequence of the job to be produced into consideration, with a corresponding, microprocessor-controlled computer means that can be a component part of the device controller 25 or of the data controller 24/1 or of the job separator 28 as well. The synchronous controller thereby aims at a parallel operation of the printer units. When, for example, the job initially contains ten monochromatic pages and then one colored page, the printer units 10 and 11 are operated in parallel, and the colored page is intermediately stored until the tenth monochromatic page has been produced. The color page is then supplied to the sheet collecting means via the corresponding paper transport channel and the common job is thus formed.

In the exemplary embodiment of the synchronous control means according to FIG. 11, the monochromatic printer unit 10 comprises a shared data controller 24/3 for both printer units 10 and 11. The job separator can also be integrated in it. In this case, the print server 27 sends all print data to this data controller 24/3, which separates the job and in turn drives the color printer unit 11, analogous to the exemplary embodiment of FIG. 10. A communication module 26 is also required given this constellation in order to assure the chronologically correct merging of the printed pages in the correct sequence. A shared data controller 2413 for both printer units 10 and 11 can be advantageous due to the lower controller outlay when very little chromatic printing is carried out compared to the monochromatic printing. However, it can also be integrated in the chromatic printer unit 12 instead of in the monochromatic printer unit 11.

Figure 12:
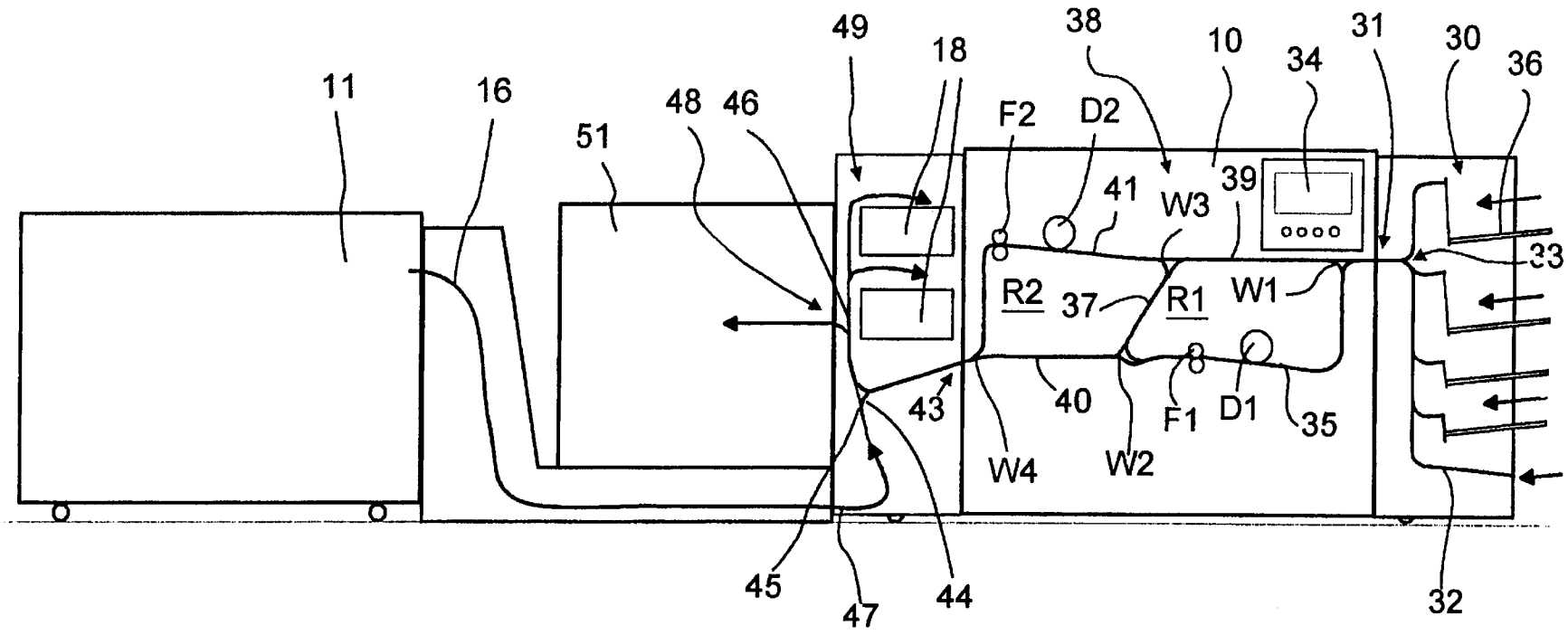
FIG. 12 is a schematic sectional view of an electrographic printer device system composed of a highlight single sheet high-performance printer and of a single sheet full-color printer whose paper transport paths are connected to one another at the output side of the highlight color printer system.

FIG. 12 shows a printer system that corresponds to the exemplary embodiment of FIG. 1 in terms of fundamental structure. The color printer unit 11 is thereby connected to the output region of the printer unit 10 via the paper path coupling module 16. It can be a single sheet color printer unit or a continuous form color printer unit with a following cutter means. The printer unit 10 is essentially composed of an input station 30, of a printing station 38 and of an output station 49. Two transfer printing stations D1 and D2 that respectively print monochromatically are located in the printer station 38. A majority of the print data supplied to it can be printed in a first color, for example black, and selected data can be printed with a second color, for example, with this highlight printer station in order to emphasize these regions on the printed matter that is produced. Such a printer station, on the one hand, is not capable of producing full-color printing but, on the other hand, can achieve an essentially equally high page performance as a corresponding monochromatic printer unit. In order to drive a highlight color printer station in an inventive printer system, the print server or, respectively, the job separator is also in the position to recognize highlight color printed data from the original print data stream of the network or host computer and supply to the highlight color printer unit 10. The controller 25/1 of the highlight color printer unit 10 then conducts the respectively appertaining data to the two transfer printing stations D1 and D2, for example data of the color black to the first transfer printing station D1 and data of the color red to the second transfer printing station D2.

The printer unit 10 shown in FIG. 12 corresponds to the known printer of the assignee having two printer units that is disclosed in Published PCT Application WO 98-18052 A1. The content of this WO publication is thus incorporated into the present specification by reference.

The printer station 38 of the printer unit 10 is kept variable insofar as the two transfer printing stations D1 and D2 are respectively interchangeable. Without further ado, thus, the printer station 38 can be re-equipped from a highlight color printer station to a monochromatic printer station that prints only in a single color overall, in that, for example, both the transfer printing station D1 as well as the transfer printing station D2 print in the same color, for example, black. As a result of this refitting possibility, a multitude of possible print applications derive, so that a very flexible printer system arises overall. A multitude of operating modes can be implemented with the printer station 38.

The first transfer printing path 35, a connecting channel 37 and a delivery channel 39 form a first ring R1 that is allocated to the first transfer printing station D1. Correspondingly, a second transfer printing path 41, the discharge channel 40 and the connecting channel 37 form a second ring R2 that is allocated to the second transfer printing station D2. The two rings R1 and R2 thus comprise a shared path section, the connecting channel 37, and form a structure in the shape of an 8.

A plurality of supply compartments 36 for stacks of single sheets are arranged in a known way in the input station 30. They are respectively emptied via a shared output path 33, and the sheets are handed over from this output path to the input path 31 of the printer station 38. The input station can thereby be fashioned as a module that can be mechanically coupled to the printer station 38. Sheets can also be supplied from the outside via an input channel 32. This delivery can enable either a delivery of additional input stations or, as already shown in FIG. 2, a delivery from the sheet buffer store 16 or, respectively, directly from the color printer unit 11.

In a first operating mode, sheets are printed on one side, i.e. in simplex operating mode, in that recording medium sheets are supplied from an input path 31 of the printer via a shunt W1 to the transfer printing path 35 of the first transfer printing station D1 for printing. Subsequently, the sheets are fixed in a fixing station F1 and are supplied via shunt W2 to a discharge channel 40, from the latter to the shunt W4 via the discharge channel 40 and then into the output channel 43. The printed sheets are then supplied directly to the deposit compartments 18 via the shunt 44 or are previously turned over at the turnover station 45. Optionally, the printed sheets can be supplied via an output shunt 46 to an output channel 48 through which the printed sheets are supplied to further devices for post-processing, for example to a binder means 51 or to an external stacker.

Given this simplex operating mode with only one transfer printing station, the second transfer printing station D2 is not in operation. This operating mode can be particularly utilized when a malfunction is present at the transfer printing station D2 or when minor surface interventions are to be carried out. In exactly the same way, a second simplex operating mode can be implemented wherein the first transfer printing station D1 is out of operation and sheets are supplied from the working path 31 of the printer via shunt W1, a delivery channel 39, a shunt W3 to the transfer printing path 41 of the second transfer printing station D2 for printing. The printed pages are subsequently fixed in the second fixing station F2 and are in turn supplied via the shunt W4 to the output channel 43.

In a third simplex operating mode with enhanced printing speed, nearly twice as many sheets can be printed as in the two first simplex operating modes. In this third simplex operating mode, sheets are shot from the input station 30 into the input path 31 at approximately twice the speed and are supplied from the shunt W1 directly to the first transfer printing path or the delivery channel 39 in alternation. Subsequently, the sheets following one another in the input path 31 are nearly simultaneously printed in the two transfer printing stations D1 or, respectively, D2 and are supplied to the output channel 43 in alternation at the shunt W4 in the original sequence.

In a simplex highlight color operating mode, sheets are supplied for the input path 31 via the first transfer printing path 35, the first transfer printing station D1 for printing in a first color, for example black. From here, the sheets are supplied via shunt W2 to a connecting channel 37 and are forwarded via shunt W3 to the second transfer printing path 41. Here, a sheet is respectively printed by the transfer printing station D2 in a second color, for example red, on the same side as in the transfer printing station D1 and is subsequently output.

In a first duplex operating mode, sheets are supplied from the input path 31 to the transfer printing station D1 for printing the front side, are then supplied via the shunt W2 to a connecting channel 37 and are supplied via shunt W3 to the second transfer printing path 41. The sheet can thereby be turned over at the shunt W2 or shunt W3, so that it is printed on the backside in the transfer printing path 41 of the second transfer printing station D2. This duplex operating mode is particularly suited for monochromatic, i.e. same-colored printing of a sheet on the front and back side.

In a highlight color duplex operating mode, sheets are supplied from the input path 31 via the first transfer printing path 35 to the first transfer printing station D1 for printing the front side with the color black. From here, the sheets are supplied via the shunt W2, the connecting channel 37 and the shunt W3 to the second transfer printing path 41. Here, the sheets are printed with the second transfer printing station D2, likewise on the front side but with the second color, red. The sheets are then supplied via the shunt W4 to the output channel 43, are turned over at the shunt 4 and are transported into the discharge channel 40 via the shunt W4. From here, the sheet is resupplied via the shunt W2 to the connecting channel 37 and to the delivery channel 39 via the shunt W3. From here, the sheet is resupplied via the shunt W1 to the first transfer printing path 35 and is printed on the back side with the first transfer printing station D1. Subsequently, the sheet, in the same way as set forth above, can be supplied to the second transfer printing station D2 for printing the back side with the second color and can then be output via the output channel 43.

In the operating mode that has just been described, the sheet is turned over in the region of the shunt W4. Alternatively thereto, the sheet, of course, can also be turned over in the shunt W2 or the shunt W3.

In an alternative highlight color duplex printer operating mode, the sheet printed in duplex by the transfer printing station D1 could be supplied via the connecting channel 37 to the second transfer printing station D1 for duplex printing in the second color. To this end, the sheet, following the initial printing with the second color, would have to be supplied via the shunt W4 to the discharge channel 40 and would have to be resupplied to the first transfer printing path 41 while being turned over.

In order to be able to implement all of the operating modes of the highlight printing station 38 set forth up to now, the sheet transports (for example stepping motors) in the delivery channel 39 and in the discharge channel 40 are drivable in two opposite directions. A reversible drive can also be provided in the connecting channel 37 for an operating mode—to be described later with reference to FIGS. 13 and 14—wherein sheets are conducted through the printing station 38 without traversing the two transfer printing transport paths 35 and 41.

In a monochrome duplex operating mode wherein printing is only carried out with the printing station D1, sheets are again supplied from the input path 31 to the printing station D1 via the first transfer printing path 35. The sheets are subsequently supplied via the shunt W2 to the connecting channel 37 and via the shunt W3 to the delivery channel 39. The sheet is thereby turned over at the shunt W2 or the shunt W3, so that it is printed on the back side when it passes through the first transfer printing path 35 again. The delivery channel 31 thus acts not only as a delivery channel in the above-described, fast simplex mode but also acts as a duplex return channel, whereby the sheets are transported back from the end of the first transfer printing path 35, i.e. from the shunt W2, to the start of the transfer printing path 35, i.e. to the shunt W1. The reversible drives in the delivery channel 39 are also needed for this functionality. After the double-sided printing of a sheet in the transfer printing station D1, the sheet is output to the output channel 43 via the discharge channel 40.

The second transfer printing station D2 is also in the position to implement a duplex operating mode by itself without a sheet being printed by the transfer printing station D1. To this end, the sheet is directly supplied to the second transfer printing station D2 via the delivery channel 39. The discharge channel 40 acts—in a way analogous to the delivery channel 39—not only as a discharge channel for the transfer printing station D1 but also as a duplex return channel for the transfer printing station D2, whereby the sheet is conducted from the end of the second transfer printing path 41, i.e. from the shunt W4, back to the input thereof, i.e. to the shunt W3. Delivery channel 39 and discharge channel 40 thereby also have a function of bypassing the transfer printing station D1 or, respectively, D2 (what is referred to as a bypass function).

In the exemplary embodiment of FIG. 12, the sheet stream output by the color printer unit 11 is introduced via the buffer store 16 into an introduction channel 47 provided in the output station 49 of the monochromatic or, respectively, highlight color printer unit 10. Although the buffer store is referred to here as a separate device, it can also be integrated within the output station 49 of the printer unit 10 or can be integrated at the output side in the color printer unit 11.

The device controller of the printer 10 controls the removal of the individual color sheets in the correct sequence, dependent on the sheet sequence that is output from the monochromatic or, respectively, highlight color printer station 38 into the output station 43 of the printer unit 10. The monochromatic printer 10 thereby serves as a mixing means (or merger apparatus). The time-exact merging of the sheet sequences from the color printer 11 and from the printing station 38 of the monochromatic printer thereby ensues in the region of the turnover station 45 of the printer 10. The mixed job that is compiled in this way is then optionally supplied via the output shunt 46 to the output channel 48 to a post-processing device, for example a binder means, or is deposited in one of the deposit compartments 18 of the monochromatic printer 10.

Inputs at the operator side about the desired operating mode (monochromatic, highlight color, simplex, duplex, etc.) of the monochromatic printer unit 10 are possible via the control panel 34. Whether the jobs are collected in the monochromatic printer 10 or are to be supplied via the output interface 48 to further post-processing devices can also be input via this control panel 34.

Figure 13:
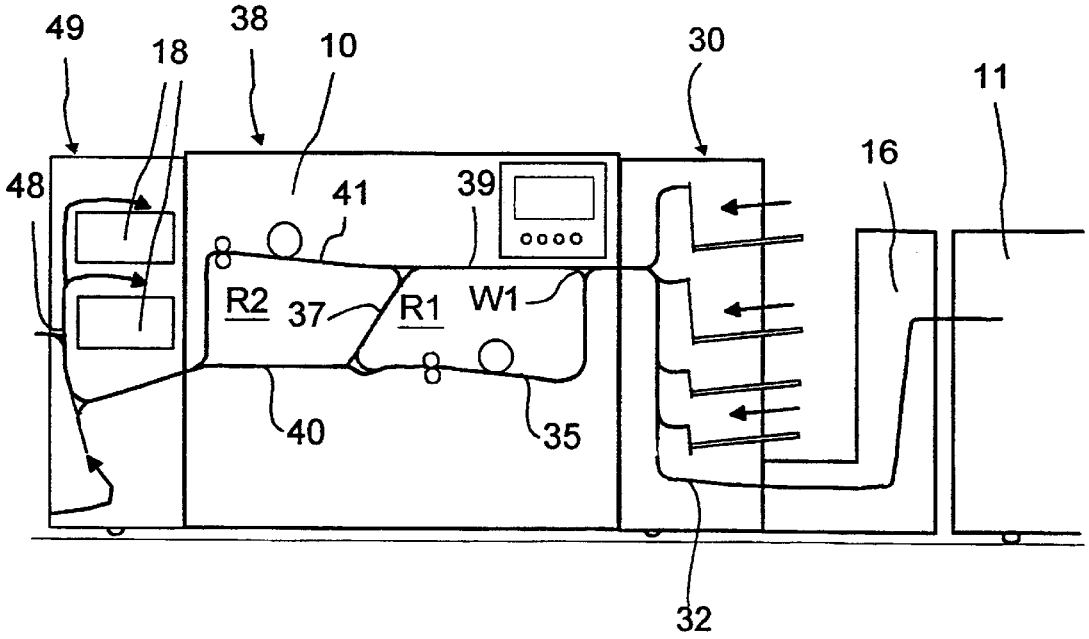
FIG. 13 is a schematic sectional view of an electrographic printer device system composed of a highlight color single sheet high-performance printer and of a single sheet full-color printer whose paper transport paths are connected to one another at the input side of the highlight color printer system.

FIG. 13 shows the coupling of the color printer 11 to the input station 30 of the monochromatic highlight color printer unit 10 via the coupling module 16. Sheets that have been printed by the color printer unit 11 are thereby transferred into the printer 10 via the input channel 32 and are then a) supplied via the delivery channel 39, the connecting channel 37 and the discharge channel 40 directly to the output station 49 without being printed in the printing unit 10 or b) supplied to one of the two transfer printing paths 35 and 41 for printing with the transfer printing stations D1 or, respectively, D2 at the shunt W1, in selective fashion. All operating modes described with reference to FIG. 12 can thereby also be implemented with the sheets transferred in from the color printer unit 11.

Figure 14:
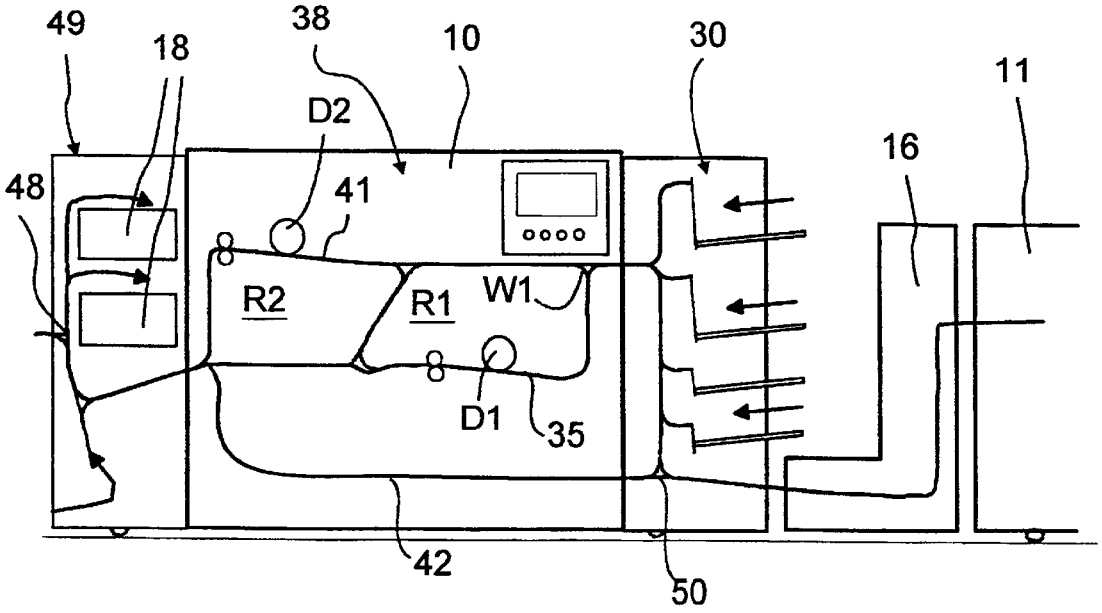
FIG. 14 is an exemplary embodiment according to FIG. 13 that additionally contains a special transport path for recording media past two printing paths.
Figure 15:
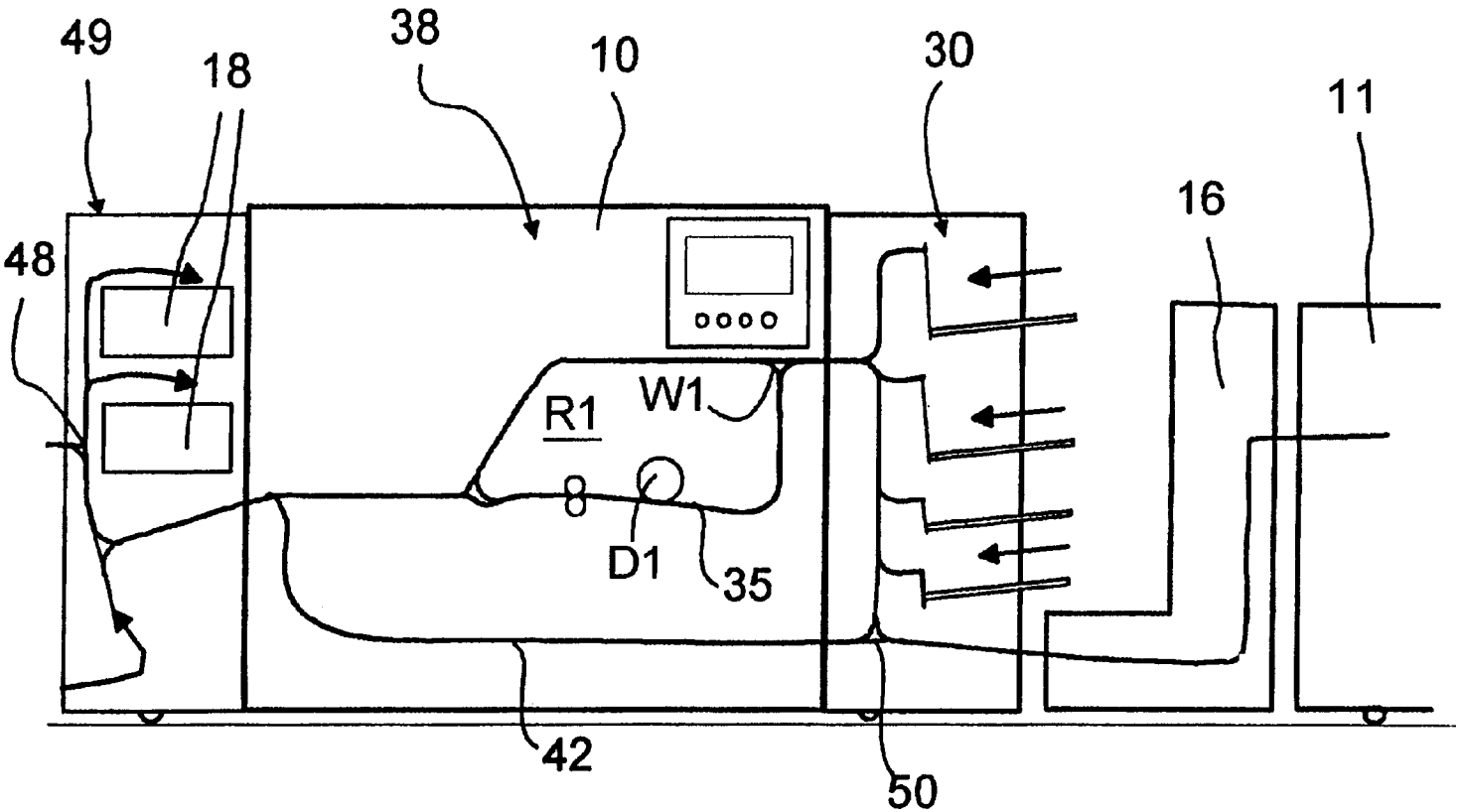
FIG. 15 is an exemplary embodiment simplified compared to FIG. 14 wherein a monochromatic printer system having only one recording color is provided instead of the highlight color printer system.

Given the exemplary embodiment shown in FIG. 14, a special path 42 into which sheets can be transferred via an input shunt 50 is provided in addition to the exemplary embodiment shown in FIG. 13. Sheets that have been printed by the color printer unit 11 can be optionally moved past the two transfer printing stations D1 and D2 directly to the output station 49 or—via the shunt W1—to the transfer printing station 38 for printing one color (monochromatic) or in two colors as a highlight color print. The transport channels 35, 39 and 41 allocated to the two rings R1 and R2 thereby need not be traversed, these paths being thus available uninterrupted for the printing procedures in the printing station 10. Sheets from the supply compartments 36 can also be transported in the special path 42 via the three-way shunt 50 directly to the output station 49 without using the transport channels of the rings R1 and R2.

In an exemplary embodiment, which is somewhat simplified compared to FIG. 14, the transfer printing station D2 as well as the transfer printing transport path 41 thereof are omitted. The printing system 10 is then only capable of printing monochromatically in exactly one color with the transfer printing station D1, but has the duplex functionality wherein sheets at the output side are resupplied to the transfer printing station D1. In this exemplary embodiment, too, the special path 42 can be advantageously utilized because sheets that come from the color printing unit 11 need not be transferred into the ring system R1 of the transfer printing station D1. The other elements of the exemplary embodiments of FIGS. 12 through 14 can thereby be incorporated.

Many exemplary embodiments have been described. It is thereby clear that individual elements of the corresponding parts of the description and/or Figures can be transferred without further ado to other parts of the description and/or Figures and/or can be combined with one another.

Although other modifications and changes may be suggested by those skilled in the art, it is the intention of the inventors to embody within the patent warranted hereon all changes and modifications as reasonably and properly come within the scope of their contribution to the art.

What is claimed is:

1. A method for producing a predetermined sheet sequence of single sheets printed monochromatically and/or multi-colored in a printer or copier system, comprising the steps of:

a) printing a first sequence of recording media at a first speed on one side or both sides monochromatically or in two colors in a monochromatic or highlight printer unit with a first paper transport channel that is individually driven and is fashioned as an independent structural unit;

b) printing a second sequence of recording media on one side or both sides in full color in a color printer unit with a second paper transport channel that is individually drivable and fashioned as an independent structural unit, said second printing step being performed at a second, lower speed compared to the first speed;

c) feeding at least one of the first and the second sequence of recording media to a paper path coupling module connected to said first and second paper transport channels; and d) producing the predetermined sheet sequence of the recording media from the first and the second sequence of recording media and the predetermined sheet sequence to at least one of a shared sheet collecting means and post-processing means in the predetermined sheet sequence; and e) separating incoming print data into monochromatic and color print job data with a synchronous control and communicating the respective print job data to the corresponding printer units.

2. A method according to claim 1, wherein a sequence of the recording media in the predetermined sheet sequence is determined by a print data stream that contains at least one of monochromatic data and highlight data on one hand and, on another hand, color data, wherein the monochrome data or the highlight color data are supplied to the monochromatic or highlight printer unit and the color data are supplied to the color printer unit, and further comprising the step of:-producing the predetermined sheet sequence by an electronic controller according to the print data stream.

3. A method according to claim 1, further comprising the steps of: driving the printer u nits and the paper path coupling module time-organized by the synchronous control, and taking the printing speeds of the printer units and the sequence of the sheet sequence into consideration such that production of the predetermined sheet sequence ensues speed-optimized optimized given largely a parallel operation of the printer units.

4. A method according to claim 1, further comprising the steps of: printing recording media in advance in the color printer unit, storing the printed recording media in a buffer storage, and supplying the printed recording media from the buffer storage into a sequence of the recording media of the monochromatic or highlight color printer unit.

5. A printer or copier device system for producing a predetermined sheet sequence of single sheets printed monochromatically and/or in full color, comprising:

a) an individually drivable monochromatic or highlight color printer unit with a first paper transport channel fashioned as independent structural unit for single-sided or both-sided printing of a first recording medium as a monochrome or as a highlight color print at a first speed;

b) an individually drivable color printer unit with a second paper transport channel fashioned as an independent structural unit for single-sided or both-sided, full-color printing of a second recording medium at a second, lower speed compared to the first speed;

c) a paper path coupling module connected to the first and second paper transport channels of the monochromatic or highlight color printer unit and to the color printer unit that accepts the printed first and/or second recording media and supplies them to a shared sheet collector and/or post-processing unit for the sheet sequence; and d) a synchronous control connected to the monochromatic or highlight color printer unit and to the color printer unit with which incoming print data is separated into monochromatic and color print job data and the respective print job data is communicated to the corresponding printer units.

6. A printer or copier device system according to claim 5, wherein the monochromatic or highlight color printer unit is a single sheet printer unit, and wherein the sequence of recording media from the color printer unit is supplied into an output region of the monochromatic or highlight color printer unit.

7. A printer or copier device system according to claim 6, wherein the sheet sequence from the output region is supplied to one of a device output and to an internal stacking means of the output region.

8. A printer or copier device system according to claim 5, wherein the synchronous control controls at least one of the printer units and the paper path coupling module taking the printing speeds of the printer units and the predetermined sheet sequence into consideration, such that production of the sheet sequence ensues speed-optimized given far-reaching utilization of a parallel operation of the printer units.

9. A printer or copier device system according to claim 5, wherein the synchronous control is connected to at least one of the paper path coupling module and a print data source.

10. A printer or copier device system according to claim 5, wherein the sequence of the recording medium from the color printer unit is supplied into an input region of the monochromatic or highlight color printer unit.

11. A printer or copier device system according to claim 10, further comprising: at least one transfer printing station, an appertaining transfer printing transport path and a special paper path in the monochromatic or highlight color printer unit via which sheets are transported directly from the input region to an output region bypassing at least one of the transfer printing stations and the transfer printing transport path of the monochromatic or highlight color printer unit.

12. A printer or copier device system according to claim 5, wherein the synchronous control includes a device controller of the monochromatic or highlight color printer unit and a device controller of the color printer unit that are coupled to one another according to a master-slave principle for controlling the sheet sequence.

13. A printer or copier device system according to claim 12, wherein the device controller of the monochromatic or highlight color printer unit is the master.

14. A printer or copier device system according to claim 5, further comprising:

a controllable buffer storage functionally allocated to at least one of the paper transport channels of the monochromatic or highlight color printer unit and to the color printer unit for the recording media.

15. A printer or copier device system according to claim 14, wherein said controllable buffer storage is in a further paper transport channel of the paper path coupling module.

16. A printer or copier device system according to claim 5, wherein the synchronous control includes:

a data controller in both of said printer units, the printer units being in communication with one another in a master-slave coupling;

a job separator that, on one hand, separates incoming print data of an external data source into monochromatic and chromatic print job data, wherein, for sequence administration, each printed page comprises a specific address or feature and a respective print job data are then communicated to the corresponding printer units, and that, on another hand, forms sequence data allocated to the sequence of the single sheets and communicates the sequence data to the printer unit having a master function, wherein the printer unit having the master function controls the other printer unit and/or the paper path coupling module for producing the sheet sequence.

17. A printer or copier device system according to claim 5, wherein the synchronous control includes:

a data controller shared by both printer units;

the data controller includes a job separator allocated to it that, on one hand, separates incoming print data of an external data source into monochromatic and chromatic print job data whereby, for sequence administration, each printed page comprises a specific address or feature, and that, on another hand, forms sequence data allocated to the sequence of the single sheets, wherein the printer unit with the data controller controls at least one of the other printer unit and the paper path coupling module for producing the sheet sequence.

18. A printer or copier device system according to claim 5, wherein one of the two printer units accepts and outputs pre-printed single sheets.

19. A printer or copier device system according to claim 5, wherein the paper path coupling module supplies t he printed recording media to the paper transport channel of the respectively other printer unit such that it can be additionally printed by the other printer unit.

20. A printer or copier device system according to claim 5, wherein the printer units are independently operable electrographic printer devices.

21. A printer or copier device system for performance-adapted production of a predetermined sheet sequence of single sheets printed. monochromatically and/or in full color, comprising:

a) an individually drivable monochromatic or highlight color printer unit with a first paper transport channel fashioned as an independent structural unit for single-sided or both-sided printing of a first recording medium as a monochrome or as a highlight color print with a first speed;

b) an individually drivable color printer unit with a second paper transport channel fashioned as an independent structural unit for single-sided or both-sided color printing of a second recording medium with a second, lower speed compared to the first speed;

c) a paper path coupling module connectible to the first and second paper transport channels of the monochromatic or highlight color printer unit and the color printer unit that accepts printed first and/or second recording media and supplies them to a shared sheet collector and/or post-processor for the sheet sequence;

d) a synchronous control that, taking printing speeds of the printer units and the sequence of the sheet sequence into consideration, drives the printer units and the paper path coupling module time-organized such that production of the sheet sequence ensues speed-optimized upon farthest-reaching utilization of a parallel operation of the printer units; and d1) the synchronous control includes a job separator that separates incoming print data of an external data source into monochromatic and color print job data and then communicates the monochromatic print job data to the monochromatic printer unit and the color print job data to the color printer unit.

22. A printer or copier device system according to claim 21, comprising:

a controllable buffer storage for the corresponding recording medium that is functionally allocated to the paper transport channel of the monochromatic printer unit and/or to the color printer unit.

23. A printer or copier device system according to claim 22, wherein the buffer storage is arranged in a further paper transport channel of the paper path coupling module.

24. A printer or copier device system according to claim 21, wherein the synchronous control includes:

both printer units include a data controller, whereby the printer units are in communication with one another in a master-slave coupling;

the job separator that, on one hand, forms print job data, wherein, for sequence administration, each printed page has a specific address or feature and that then communicates them to the corresponding printer unit, and that, on another hand, forms sequence data allocated to the sequence of the single sheets that it communicates to the printer unit having a master function, wherein the printer unit having the master function controls the other printer unit and/or the paper path coupling module for producing the sheet sequence.

25. A printer or copier device system according to claim 21, wherein the synchronous control includes:

one of the two printer units has a data controller shared by both printer units;

the data controller has the job separator allocated to it that, on one hand, separates incoming print data of an external data source into monochromatic and chromatic print job data wherein, for sequence administration, each printed page includes a specific address or feature, and that, on another hand, forms sequence data allocated to the sequence of the single sheets, whereby the printer unit with the data controller controls the other printer unit and/or the paper path coupling module for producing the sheet sequence.

26. A printer or copier device system according to claim 21, wherein the shared sheet collector is a continuous form printer unit for printing web-shaped recording media and further comprising:

a sheet cutter means allocated to the continuous form printer unit.

27. A printer or copier device system according to claim 21, wherein one of the two printer units includes an insert apparatus for acceptance and output of pre-printed single sheets.

28. A printer or copier device system according to claim 21, wherein at least one of the two printer units includes an insert apparatus for acceptance and output of pre-printed single sheets allocated to it.

29. A printer or copier device system according to claim 21, further comprising:

a paper path coupling module that accepts the recording medium printed by the printer unit of the monochromatic printer unit and supplies it to the paper transport channel of the respectively other printer unit, wherein the sheet collector is in the printer unit accepting the printed recording medium.

30. A printer or copier device system according to claim 29, wherein the paper path coupling module supplies the printed recording medium to the paper transport channel of the respectively other printer unit such that it can be additionally printed by the accepting printer unit.

31. A printer or copier device system according to claim 30, wherein the paper path coupling module includes a switchable paper shunt having a first switch position wherein the recording medium is directly supplied to the sheet collecting means and having a second switch position wherein the recording medium is first printed anew and then deposited in the sheet collecting means.

32. A printer or copier device system according to claim 21, wherein the printer units are independently operable electrographic printer devices.

33. A printer or copier device system according to claim 21, whereby the paper path coupling module is a part of said monochromatic or highlight color or color printer unit.

34. A method for performance-adapted production of a predetermined sheet sequence of single sheets printed monochromatically and/or in color, comprising the steps:

a) printing a first recording medium monochromatically single-sided or both-sided with a first maximum speed with an individually drivable monochromatic printer unit with a first paper transport channel that is fashioned as an independent structural unit;

b) printing a second recording medium in color single-sided or both-sided with a second, lower maximum printing speed compared to the first printing speed with an individually controllable color printer unit with a second paper transport channel fashioned as an independent structural unit;

c) accepting the printed first and/or second recording media by a paper path coupling module connectible to the paper transport channels of the monochromatic printer unit and to the color printer unit and supplying to a shared sheet collecting means and/or post-processing means for the sheet sequence; and d) taking printing speeds of the printer units and the sequence of the sheet sequence into consideration, the printer units and the paper path coupling module are driven by a synchronous control means time-organized such that the production of the sheet sequence ensues speed-optimized upon farthest-reaching utilization of a parallel operation of the printer units;

d1) separating incoming print data of an external data source by the synchronous control means containing a job separator into monochromatic and color print job data and then communicating the monochromatic print job data to the monochromatic printer unit and communicating the color print job data to the color printer unit.

35. A method according to claim 34, further comprising the step of:

storing the recording media intermediately in a buffer store functionally allocated to the paper transport channel of the monochromatic printer unit and/or to the color printer unit.

36. A method according to claim 34, further comprising the step of:

separating incoming print data of an external data source into monochromatic and color print job data with the job separator and communicating the respective print job data to the corresponding printer unit.

37. A method according to claim 36, further comprising the step of:

connecting the two printer units with one another in a master-slave outlying, and wherein sequence data allocated to the sequence of the individual sheets are formed and these are communicated to the printer unit with a master function.

38. A method according to claim 37, wherein, for producing the sheet sequence, the printer unit with the master function controls the other printer unit and/or the paper path coupling module.

* * * * *